United States Patent [19]

Tuleja

[11] 4,199,827

[45] Apr. 29, 1980

[54] DRAIN TRAPS WITH STRAINER MEANS

[76] Inventor: Anthony Z. Tuleja, P.O. Box 1564, Sarasota, Fla. 33578

[21] Appl. No.: 839,207

[22] Filed: Oct. 4, 1977

[51] Int. Cl.[2] ..... E03C 1/26

[52] U.S. Cl. ..... 4/289; 4/290

[58] Field of Search ..... 4/286, 287, 288, 289–292, 4/DIG. 14; 200/435, 474, 238; 137/247.51

[56] References Cited

U.S. PATENT DOCUMENTS

| | | | |
|---|---|---|---|
| 1,798,441 | 3/1931 | Weiss | 4/292 |
| 1,817,376 | 8/1931 | Izquierdo | 4/291 |
| 1,935,128 | 11/1933 | Pullman | 4/286 |

FOREIGN PATENT DOCUMENTS

| | | | |
|---|---|---|---|
| 529887 | 11/1940 | United Kingdom | 4/DIG. 14 |

*Primary Examiner*—Willis Little

*Attorney, Agent, or Firm*—James C. Wray

[57] ABSTRACT

U-shaped drain traps are provided wherein strainer means are disposed within the trap for entrapping various size particles and valuable articles which have accidentally entered the drain. The trap is provided with access means for permitting the strainer means to be placed within or withdrawn from a vertical or horizontal section of the trap. The strainer means are novel construction for the purpose of entrapping particles and for ease of handling.

1 Claim, 12 Drawing Figures

DRAIN TRAPS WITH STRAINER MEANS

BACKGROUND OF THE INVENTION

This invention relates to waste pipe traps usable with sinks and the plumbing fixtures, which permit the free flow of waste liquid therethrough, prevent the flow of sewer gas, and which can be easily kept free of sediment, etc. which tends to clog the trap. The traps of this invention are designed to separate solid and other foreign bodies from the liquids in the waste pipes, and particularly to entrap valuable items such as rings, contact lenses, etc. which may accidentally fall into the waste pipes.

The prior art discloses various drain and pipe trap means adapted for use in waste pipes for entrapping solids and permitting the flow of waste liquid. Patents disclosing trap means adapted for use directly with the waste drain pipes connected to the sink are as follows:

U.S. Pat. No. 594,169
U.S. Pat. No. 1,770,639
U.S. Pat. No. 1,886,676
U.S. Pat. No. 1,903,366
U.S. Pat. No. 3,788,485.

In the prior art patents, the trap means are located in the conventional pipe section forming the U or gas trap portion below the drain portion of the sink, etc. as follows:

U.S. Pat. No. 1,198,759
U.S. Pat. No. 1,217,763
U.S. Pat. No. 1,817,376
U.S. Pat. No. 2,593,734
U.S. Pat. No. 3,935,602.

Although many of the above trap means can do a satisfactory separation of solids from the liquids, the trap means are difficult to gain access to and to clean, and furthermore, do not contain trap means for doing an adequate separation of the solids from the waste liquid.

BRIEF DESCRIPTION OF THE INVENTION

An object of this invention is to provide novel drain traps and strainer means.

A further object of the invention is to provide drain traps having means for easy access for cleanout purposes and for the retrieval of valuable articles accidently entering a drain.

Another object of this invention is to provide a variety of strainer means adapted to be disposed in the novel drain traps for the purpose of entrapping particles and valuable articles while permitting the flow of waste fluid through the drain trap.

The above objects are accomplished by the invention in the provision of U-shaped drain traps having a novel construction wherein access to the trap is through a horizontal or vertical section of the U-shaped construction. The construction comprises an opening which can be sealed by means of a nut member. Within the horizontal or vertical section of the trap, strainer means are provided for the purpose of entrapping various size particles and valuable articles which may have accidentally entered the drain. The strainer means comprise various types in accordance with the invention and generally include finger-like entrapping means or basket-like means having a mesh construction with various size openings.

BRIEF DESCRIPTION OF THE DRAWINGS

The invention is best described by reference to the preferred embodiments as illustrated in the drawings wherein.

DESCRIPTION OF THE PREFERRED EMBODIMENTS

Figure 1:
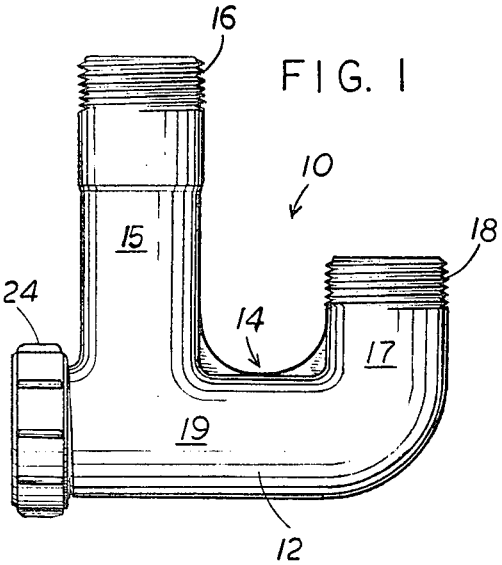
FIG. 1 is a side elevational view of an embodiment of the drain traps of the invention.

Referring now to the drawings and particularly to FIGS. 1–4, a drain trap unit 10 is shown as the first embodiment of the invention and comprises a U-shaped integral trap member 12 with conventional dip portion 14 having vertical conduit sections 15 and 17, horizontal section 19, and threaded open ends 16 and 18 adapted to be connected to a drain pipe of a sink and an outlet pipe (both not shown), respectively. The trap is provided with an opening 20 (FIG. 3) with threads 22. An internally threaded nut 24 is adapted to be threaded onto threads 22 and thereby close the opening 20. An O-ring 26 is placed in an annular recess 28 of the nut to seal the opening tightly. The O-ring shown herein is ovate in cross-section and was found to be better suited than the conventional round O-ring to seal the opening, because the ovate shape molds into the recess 28 and edge 30 tightly.

Figure 2:
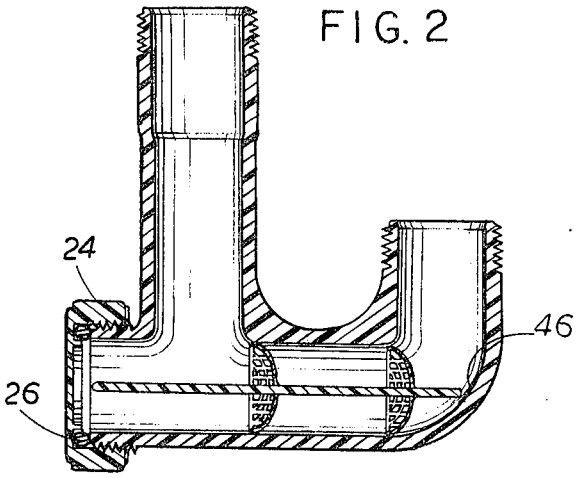
FIG. 2 is a longitudinal cross-sectional view of the drain trap of FIG. 1, disclosing a strainer means of the invention disposed therein.
Figure 3:
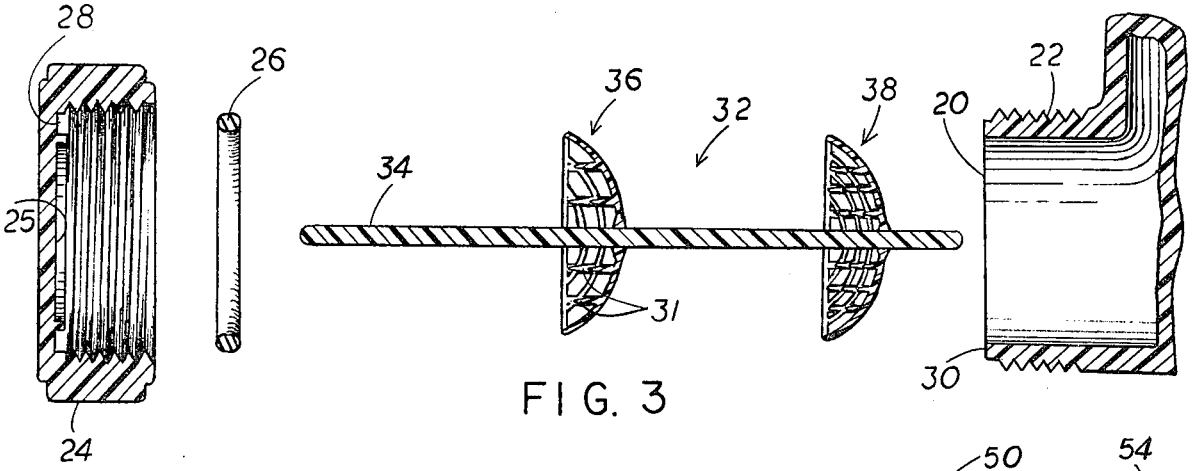
FIG. 3 is a partial enlarged cross-sectional view similar to FIG. 2 showing the disassembled drain trap and strainer means.
Figure 4:
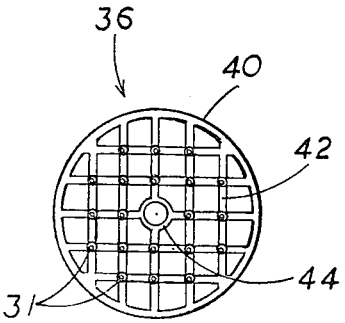
FIG. 4 is a front view of one element of the strainer means shown in FIGS. 2 and 3.

Within the trap member 12, the horizontal section 19 is adapted to receive and contain the various strainer means of the invention. In FIG. 2, a strainer means 32 (see FIG. 3) is disposed in the horizontal section 19. Strainer means 32 comprises rod means 34 and a pair of cup-like strainer members 36 and 38. Each strainer member (see FIG. 4) comprises an annular rim 40 with a mesh structure 42 forming the cup portion, and an axial hole 44. The strainer members are adapted to be mounted at spaced distances by means of hole 44 on the rod 34. The strainer members 36 and 38 have different mesh size openings with 36 having larger openings than those of 38. Horizontal pins 31 extend on 36 and 38 forwardly from the mesh structure to hold larger particles away from the mesh surface.

Strainer means 32 is disposed in horizontal section 19 of the trap through opening 20 and the diameters of members 36 and 38 are adapted to be somewhat smaller than the inner diameter of horizontal section 19 of the drain trap 10. The length of the rod 34 is adapted to be slightly smaller than the inside axial length of section 19. The ends of rod 34 retain the strainer 32 in place by freely abutting against the inside 25 of nut 24 and the curved inner portion 46 of the trap unit.

Strainer member 36 having larger mesh opening will permit relatively smaller particles to pass through whereas member 38 with smaller mesh openings will tend to retain the smaller particles. Accordingly, there will be a buildup of relatively larger particles on member 36 and smaller particles on member 38. It is understood within the invention, that more than two strainer members could be disposed on the rod 34 having progessively smaller mesh size openings downstream.

The structure of strainer members 36 and 38 are such that they will retain any large valuable articles such as rings, earrings, contact lenses, etc. which may accidentally enter the drain. Retrieval of the valuable articles is simply accomplished by removing nut 24 and withdrawing strainer means 32. The purpose of the strainer means 32 is to provide a drain trap to prevent stoppage of relatively inaccessible downstream drain pipes. The use of strainer members having progressively smaller mesh size openings permits separation and retention of larger and smaller particles in the trap and enables longer usage of the trap between cleanouts. The trap thus has for its purpose both the immediate access for valuable articles as well as retaining various sized foreign particles for eventual cleanout.

Figure 5:
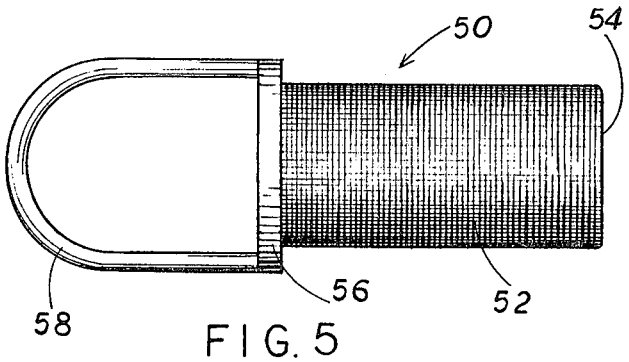
FIG. 5 is a side elevational view of a second strainer means of the invention for use with the drain traps of the invention.
Figure 6:
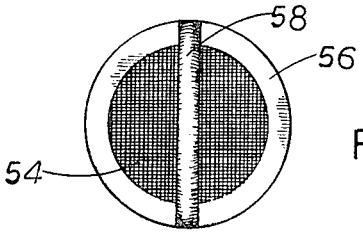
FIG. 6 is an end elevational view of the strainer means shown in FIG. 5 as seen from the left side of FIG. 5.
Figure 8:
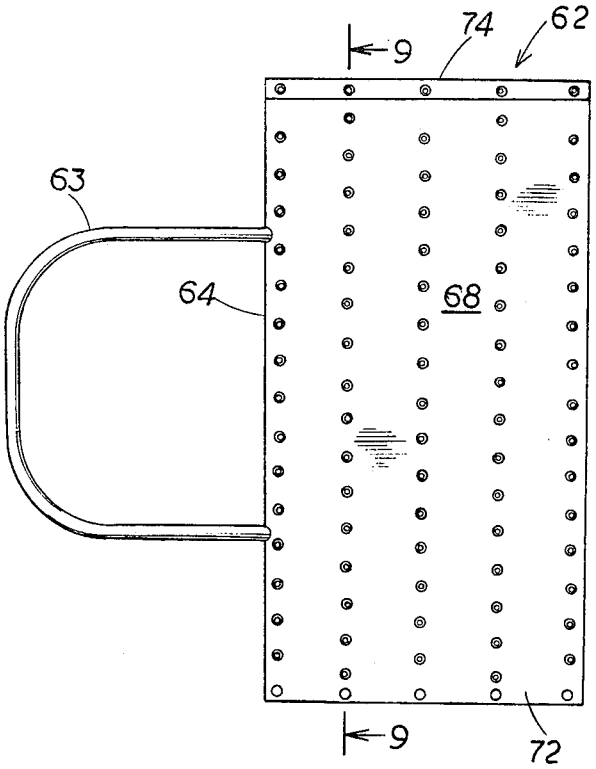
FIG. 8 is a top plan view of the development member used to form the strainer means shown in FIG. 7.
Figure 9:
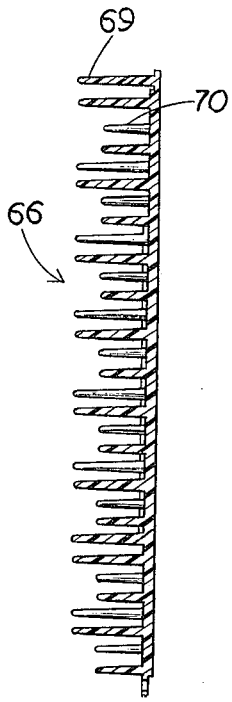
FIG. 9 is a sectional view taken along line 9—9 of FIG. 8.
Figure 10:
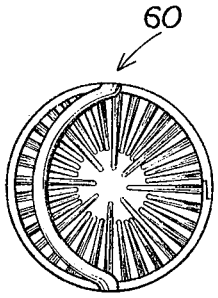
FIG. 10 is an end view of the strainer means as seen from the left side of FIG. 7.
Figure 7:
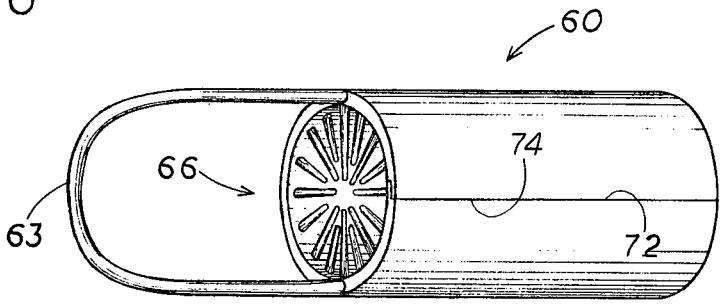
FIG. 7 is a side perspective view of a strainer means of the invention for use with the drain traps of this invention.

Referring now to FIGS. 5 and 6, a second type of strainer means 50 is shown which can be used in the horizontal section of drain trap 10 similarly as strainer means 32. Strainer means 50 comprises an open mesh basket 52 with bottoms 54 and an open top section connected to a ring member 56, and handle means 58 rigidly connected to the ring member. Strainer means 50 is adapted to be inserted through opening 20 of the drain trap by means of handle 58 and into horizontal section 19 of the trap. The outer diameter of ring member 56 is slightly smaller than the inner diameter of horizontal section 19. The mesh size openings of the basket 52 are adapted to be suitable to retain various size particles and are preferably of a fine mesh size. Basket 54 will retain the various particles and as it fills with particles fluid flow is not impeded since it can flow out the sides of the basket. When the basket is filled with particles, fluid flow will be impeded and the basket can be removed for cleaning and replacing in the section 19.

In FIGS. 7–10, a third type of strainer means 60 is shown which can be used in the horizontal section of drain trap 10 similarly as strainer means 32. Strainer means 60 is formed from development member 62 which comprises a handle member 63 a rectangular panel 64 having a plurality of fingers 66 extending perpendicularly from one surface 68. Fingers 66 are spaced in rows along surface 68 and the fingers are of two different lengths 69 and 70. Development member 62 is adapted to be formed into a cylinder by secuting edges 72 and 74 together by suitable means with the fingers radially inwardly extending within the cylinder. The cylinder with the handle 63 and fingers 66 form the strainer means 60. The fingers are adapted to retain various sized particles and to permit fluid to flow therethrough.

Figure 11:
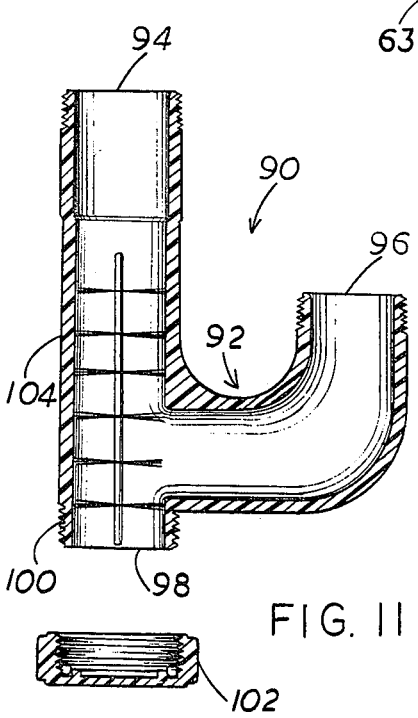
FIG. 11 is a longitudinal sectional side view of a second embodiment of the drain traps of this invention disclosing a fourth strainer means of the invention disposed therein.
Figure 12:
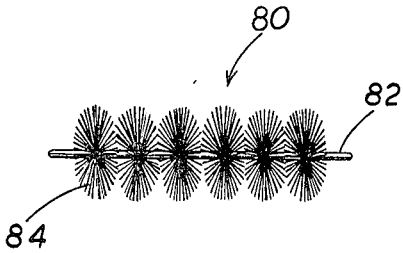
FIG. 12 is a side perspective view of the strainer means shown in FIG. 11.

In FIG. 12, a fourth type of strainer means 80 is shown which can be used in the horizontal section of drain 10 similarly as strainer means 32. However, in FIG. 11 a second embodiment of the drain trap 90 is shown with the strainer means 80 disposed therein.

Drain trap 90 comprises a U-shaped integral trap member with conventional dip portion 92 and threaded open ends 94 and 96 adapted to be connected to drain pipe of a sink and an outlet pipe (both not shown), respectively. The trap is provided with an opening 98 with threads 100. An internally threaded nut 102 is adapted to be threaded onto threads 100 and thereby close the opening with suitable seal means (not shown). Within the trap member 90, the vertical section 104 is adapted to receive and contain the various strainer means of the invention appropriately modified to operate in a vertical position, e.g. the strainer means 50 of FIGS. 5 and 6 can be changed so the end 54 of the basket 50 is at the opposite end.

Strainer means 80 comprises rod containing a plurality of radially extending pins or wires 84 which will entrap various smaller particle sizes and permit fluid to flow therethrough. Strainer 80 is disposed vertically within vertical section 104 with the end of rod 82 resting on the inner surface of nut 102.

Either waste trap 10 or 90 can contain any of the various strainer means 32, 50, 60 or 80. Cleaning of the trap is simplified by merely removing the retaining nut and withdrawing the strainer means. The unique construction makes it a simple matter for persons not familiar with plumbing to clean the traps or retrieve valuable articles. Furthermore, in plumbing systems not used in winter time, the trap can easily be drained thereby avoiding the freezing of water in a trap.

The drain traps and strainer means of the invention can be formed or molded of various suitable plastic materials or metals. Particularly, with respect to certain transparent plastic materials, the use thereof in the drain traps permits easy visible examination of the trap to determine if a valuable is trapped therein.

Although the invention has been illustrated and described herein with reference to preferred embodiments, it is nevertheless not intended to be limited to the details shown, since various modifications may be made therein within the scope and range of the claims.

What is claimed is:

1. Strainer means disposed in a U-shaped drain trap comprising of continuous conduit means including substantially vertical parallel conduit sections and a horizontal conduit section, forming curved conduit sections at their junctures, said continuous conduit means comprising of conduit extension means outwardly disposed from the horizontal conduit section in line with a horizontal section and disposed at the curved juncture, said conduit extension means comprising a closeable opening, said horizontally disposed conduit section and conduit extension disposed at the natural sedimentation point of said drain trap, said strainer means comprising rod means having a series of cup-shaped strainer members having open mesh surfaces disposed thereon each successive member of said series of cup-shaped mesh strainer members having progressively smaller mesh size openings, said strainer means being insertable and removable through said closeable opening, said strainer means disposed horizontally in said horizontal disposed conduit and extension conduit, wherein said rod means is parallel to interior walls of horizontally disposed conduit and conduit extension, when said strainer means is inserted, said strainer means is disposed within said horizontally disposed conduit means and conduit extension and in said conduit means in the direction of the flow of waste fluid therethrough, said cup-shaped mesh strainer members being disposed transverse to the flow of said waste fluid and adapted to strain and detain foreign particles and articles carried in the said waste fluid at said natural sedimentation point, wherein the removal of the strainer means with cup-shaped mesh members having a diameter somewhat smaller than the inner diameter of the horizontally disposed conduit section and conduit extension, from said horizontally disposed conduit and conduit extension cleans the said section of foreign particles and articles strained by said strainer members wherein said removal cleans deposits in the said conduit section carried in the waste fluid where said horizontally disposed section is disposed at the natural sedimentation point of the drain trap.

* * * * *